US007037348B2

(12) United States Patent
Freisthler

(10) Patent No.: US 7,037,348 B2
(45) Date of Patent: May 2, 2006

(54) ALTERNATIVE FUEL COMPOSITION

(76) Inventor: Michael Freisthler, 501 Karen, Sidney, OH (US) 45365

( * ) Notice: Subject to any disclaimer, the term of this patent is extended or adjusted under 35 U.S.C. 154(b) by 480 days.

(21) Appl. No.: 10/267,480

(22) Filed: Oct. 9, 2002

(65) Prior Publication Data

US 2004/0025418 A1 Feb. 12, 2004

Related U.S. Application Data

(60) Provisional application No. 60/401,705, filed on Aug. 7, 2002.

(51) Int. Cl.
*C10L 1/18* (2006.01)

(52) U.S. Cl. ..... 44/389; 44/308; 44/307

(58) Field of Classification Search ..... 44/389, 44/308, 300, 388, 307
See application file for complete search history.

(56) References Cited

U.S. PATENT DOCUMENTS

| | | | | |
|---|---|---|---|---|
| 3,221,615 | A | 12/1965 | McGovern | |
| 3,261,269 | A | 7/1966 | McGovern | |
| 4,597,799 | A | 7/1986 | Schilling | |
| 4,661,378 | A | 4/1987 | McGovern | |
| 5,164,002 | A * | 11/1992 | Ballenger et al. | 106/267 |
| 5,741,502 | A | 4/1998 | Roberts | |
| 5,762,699 | A | 6/1998 | McGovern | |
| 6,086,853 | A | 7/2000 | Michaels | |
| 6,096,699 | A * | 8/2000 | Bergemann et al. | 510/201 |
| 6,156,833 | A | 12/2000 | Rauls | |
| 6,191,087 | B1 * | 2/2001 | Opre et al. | 510/201 |
| 6,281,189 | B1 * | 8/2001 | Heimann et al. | 510/491 |
| 6,306,184 | B1 | 10/2001 | Ahmed | |
| RE37,629 | E | 4/2002 | Wilkins, Jr. | |
| 6,406,673 | B1 | 6/2002 | Soller et al. | |
| 2003/0110682 | A1 * | 6/2003 | Williams et al. | 44/275 |

* cited by examiner

*Primary Examiner*—Cephia D. Toomer
(74) *Attorney, Agent, or Firm*—Emch, Schaffer, Schaub & Porcello Co., L.P.A.

(57) ABSTRACT

This alternative fuel is composed of agricultural products. A blend of esters of soybean oil and terpine hydrocarbons can be used for outdoor activities. The blend is useful for charcoal fluid, campfire fuel or decorative lamp fuel. The esters are a low volatile material and the terpenes are a higher volatile, low flash material. The blends can be used for lighting a charcoal fire for outdoor activities, a torch lantern device for outdoor patio use, trash fires, as well as outdoor heaters and stoves. In one embodiment, an insect control agent, citronella or a fragrance may be included.

21 Claims, No Drawings

ALTERNATIVE FUEL COMPOSITION

This application claims the benefit of provisional application No. 60/401,704 filed Aug. 7, 2002.

TECHNICAL FIELD

This invention relates to alternative fuel compositions using an agricultural product. More specifically, this invention relates to a fuel composition comprising soy products.

BACKGROUND OF THE INVENTION

Dependency on petroleum fuels has been an economic and environmental issue for some time. These factors have fostered the expansion of alternative fuels such as ethanol. Unfortunately, most bioenergy and energy alternatives still require the use of hydrocarbon fuel. Current use of ethanol and biodiesel as fuel additives or alternatives are limited by the relatively high cost of ethanol production and the very high cost of biodiesel production. One recent development proposed a blend of naphtha and terpene for use in 2-cycle and 4-cycle engines.

A likely market for alternative energies is within agriculture itself. Low-cost alternative fuels can be used to power farm tractors and small agricultural production and processing facilities within rural communities. Wind and solar energy, as well as biofuels, also may be utilized to supply or supplement electrical energy for water pumping, small-scale irrigation systems, and other farmstead needs.

BRIEF SUMMARY OF THE INVENTION

I have developed an alternative fuel composed of agricultural products. A blend of esters of soybean oil and terpene hydrocarbons can be used for outdoor activities. The blend is useful for charcoal fluid, campfire fuel or decorative lamp fuel. The esters are a low volatile material and the terpines are a higher volatile, low flash material. The blends can be used for lighting a charcoal fire for outdoor activities, a torch lantern device for outdoor patio use, trash fires, as well as outdoor heaters and stoves.

The blends have a pleasant fragrance, and have little or no chance of flashback. In one embodiment, the blends also may contain may contain an insect control agent or fragrance such as citronella.

DETAILED DESCRIPTION OF THE INVENTION

Generally, the alternative fuel composition is a combination of a major amount of alkyl esters of soybean oil and a minor amount of terpine hydrocarbons. A major amount is greater than 50 weight percent and a minor amount is less than 50 weight percent. The composition always includes at least 10 weight percent terpene hydrocarbon. Preferably, the alternative fuel composition is a combination of:

| Component | Weight Percent |
|---|---|
| Alkyl esters of soybean oil | 60.0 to 90.0 |
| Terpene hydrocarbon | 10.0 to 40.0 |

More preferably, the fuel composition comprises:

| Component | Weight Percent |
|---|---|
| Alkyl esters of soybean oil | 65.0 to 85.0 |
| Terpene hydrocarbon | 15.0 to 35.0 |

Still more preferably, the combination comprises:

| Component | Weight Percent |
|---|---|
| Alkyl esters of soybean oil | 70.0 to 80.0 |
| Terpene hydrocarbon | 20.0 to 30.0 |

The components of the alternative fuel may vary widely.

The preferred and most common ester of soybean oil is the methyl ester.

Terpenes are widely distributed in nature and are present in nearly all living plants. It is generally recognized that the term "terpene" not only applies to isoprene olligomers, but also to their saturated or partially saturated isomers as well as to the derivatives, which are referred to as terpenoids, such as, for example, alcohols, aldehydes, esters, and the like. Terpenes have been widely used as flavor and perfume materials. Common monoterpenes include turpentine and limonene.

The preferred terpene is limonene which is a naturally occurring chemical found in high concentrations in citrus fruits and spices.

While d-limonene is the more preferred isomer, 1-limonene may also be used in the present invention. 1-limonene also is found I naturally occurring substances such as pin-needle oil, oil of fir, spearmint, and peppermint, for example. Limonene is commercially available from Florida Chemical Company, Inc., for example, in three different grades, namely untreated/technical grade, food grade, and lemon-lime grade. The food grade comprises about 97% d-limonene, the untreated/technical grade about 95% d-limonene, and the lemon-line grade about 70% d-limonene, the balance in all being other terpene hydrocarbons and oxygenated compounds. The technical and food grades of limonene are the most preferred for use in this invention and require no additional purification to remove impurities or water.

One preferred embodiment is for dispensers such as lamps. Typically, the lamps are used to repel and/or kill insects using an insect control agent such as an insecticide, a repellent, or an insect growth regulator. A wide variety of insect control agents are known which can be used for this purpose. (Examples are those which have previously been incorporated into mosquito lamps, foggers and candles). I prefer d-cis/trans allethrin for use in mosquito control in this context.

Citronella oil also is well known to repel mosquitoes. Still other ingredients that may be included alone or in combination include ginger, camphor, cinnamon oil, rose oil, banana oil, eucalyptus, methol. These ingredients give off a pleasant odor without requiring perfume. These ingredients do not have lingering odors after being extinguished, nor do they have strong odors while burning.

The amount of insect control agents and fragrances may vary widely. Typically, the amount ranges from about 1.0 to about 10.0 weight percent. Preferably, the amount ranges from 3.0 to 7.0 weight percent. Amounts over 10 weight percent usually are excessive with little additional effect. They result in a waste of resources or provide to pungent an odor. Amounts below 1 weight percent usually are so low as to have little effect.

EXAMPLE I

The alternative fuel compositions of this invention were compared to conventional charcoal lighter fluid. The charcoal fluid had a weight of 0.764 grams/milliliter (ml). The soy orange had a weight of 0.902 grams/ml. The soy orange was a blend of 70 weight percent methyl ester of soybean oil and 30 weight percent of d-limonene. Another soy orange was an 80/20 mixture of the components. Still another mixture is an 85/15 blend.

The fluids were applied to standard charcoal as recommended rates for conventional charcoal fluid. The soy orange blends penetrated the coals as well as the standard fluids. The soy oranges burned as well as or longer than the standard fluids. All coals were well lit after 15 minutes. The soy oranges of this invention had a pleasant orange fragrance when using the same volume (1.5 oz./1 Q./1 lb of charcoal) of alternate fuel and lighting with a match or flame source. No flash or explosive result was noted. However, just as with charcoal fluids if applied to or placed on hot coals, a similar flash or ignition will occur.

EXAMPLE II

The 70/30 soy orange blend and charcoal fluid of Example I were applied to a fixed length of string. The strings were dipped in each fluid for 5 seconds. After ignition, the charcoal fluid burned for 40 seconds and the 70/30 soy orange burned for 75 seconds.

EXAMPLE III

The soy orange fluids of Example I were tested on small pen caps. A tiki fluid was used as a control. A cotton wick extended from each cap ¼ inch. Ten ml of each fluid were applied to each wick. The results were as follows:

| Fluid | Burn Time |
|---|---|
| Tiki fluid | 35 minutes |
| 80/20 soy orange | 53 minutes |
| 70/30 soy orange | 47 minutes |

All 3 fluids burned with a good flame and very little smoke.

EXAMPLE IV

The soy orange fluids of Example I were tested in two different dispensers. About 5 weight percent citronella were added to the fluids of Example I. Both dispensers were conventional outdoor products.

The first dispenser was a 2 inch high glass candle container. A 2 inch, 15 mm #2 wick with a base or clip has been found to work well when in the candle glass with the heated mixed ingredients being poured to a depth of 1-½ inches.

Another conventional dispenser is a lamp for dispensing the material. There is a burnable coil having the material, and a burn vessel for housing the coil. The vessel has openings allowing air to pass through the vessel and by the coil. A flame source is mounted above the coil. A chimney is mounted around the flame source so as to direct the material from the burning coil to be drawn into the chimney past the flame source and then up outside the chimney.

When the ingredients of the present invention are ignited, vapors are emitted. The ingredients burn cleanly and only emit vapor while ignited. The mixtures had a pleasant fragrance.

Although the now preferred embodiments of the invention have been set forth, it will be apparent to those skilled in the art that various changes and modifications may be made thereto without departing from the spirit and scope of the invention as set forth in the following claims.

I claim:

1. An alternative fuel composition consisting essentially of a combination of a major amount of alkyl esters of soybean oil and a minor amount of terpene hydrocarbons wherein the alternative fuel composition consists essentially of a combination of:

| Component | Weight Percent |
|---|---|
| Alkyl esters of soybean oil | 60.0 to 90.0 |
| Terpene hydrocarbon | 10.0 to 40.0 |

including a minor amount of an insect control agent or a fragrance wherein the insect control agent or the fragrance is citronella.

2. A fuel composition according to claim 1 consisting essentially of a combination of:

| Component | Weight Percent |
|---|---|
| Alkyl esters of soybean oil | 65.0 to 85.0 |
| Terpene hydrocarbon | 15.0 to 35.0 |

including a minor amount of an insect control agent or a fragrance wherein the insect control agent or the fragrance is citronella.

3. A fuel composition according to claim 1 consisting essentially of a combination of:

| Component | Weight Percent |
|---|---|
| Alkyl esters of soybean oil | 70.0 to 80.0 |
| Terpene hydrocarbon | 20.0 to 30.0 |

including a minor amount of an insect control agent or a fragrance wherein the insect control agent or the fragrance is citronella.

4. A fuel composition according to claim 1 consisting essentially of a combination of:

| Component | Weight Percent |
|---|---|
| Alkyl esters of soybean oil | 75.0 |
| Terpene hydrocarbon | 25.0 |

including a minor amount of an insect control agent or a fragrance wherein the insect control agent or the fragrance is citronella.

5. A fuel composition according to claim 1 consisting essentially of a combination of:

| Component | Weight Percent |
|---|---|
| Alkyl esters of soybean oil | 80.0 |
| Terpene hydrocarbon | 20.0 |

including a minor amount of an insect control agent or a fragrance wherein the insect agent or the fragrance is citronella.

6. A fuel composition according to claim 1 consisting essentially of a combination of:

| Component | Weight Percent |
|---|---|
| Alkyl ester of soybean oil | 85.0 |
| Terpene hydrocarbon | 15.0 |

including a minor amount of an insect control agent or a fragrance wherein the insect control agent or the fragrance is citronella.

7. A fuel composition according to claim 1 wherein the terpene hydrocarbon is d-limonene.

8. A fuel composition according to claim 1 wherein the alkyl ester is methyl ester of soybean oil.

9. A fuel composition according to claim 1 wherein the insect control agent is an insecticide, an insect repellent or an insect growth regulators.

10. A fuel composition according to claim 1 wherein the amount of the insect control agent or the fragrance ranges from about 1.0 to about 10.0 weight percent.

11. A fuel composition according to claim 1 wherein the amount of the insect control agent or the fragrance ranges from about 3.0 to about 7.0 weight percent.

12. A fuel composition according to claim 1 wherein the amount of the insect control agent or the fragrance is about 5.0 weight percent.

13. A method for igniting a fuel comprising the steps of (a) providing an alternative fuel composition comprising a combination of a major amount of alkyl esters of soybean oil and a minor amount of terpene hydrocarbons and igniting the fuel composition.

14. A method according to claim 13 including the step of adding the fuel composition to charcoal prior to the step of igniting the fuel composition.

15. A method according to claim 13 including the step of adding the fuel composition to a lantern prior to the step of igniting the fuel composition.

16. A method according to claim 13 including the step of adding the fuel composition to an outdoor healer or stove prior to the step of igniting the fuel composition.

17. A method according to claim 13 including the step of adding the fuel composition to an outdoor glass candle container prior to the step of igniting the fuel composition.

18. A method according to claim 13 including the step of adding an insect control agent or a fragrance to the fuel composition prior to the step of igniting the fuel composition.

19. An alternative fuel composition comprising a combination of a major amount of alkyl esters of soybean oil and a minor amount of terpene hydrocarbons including a minor amount of an insect control agent or a fragrance, wherein the insect control agent is citronella.

20. An alternative fuel composition comprising a combination of a major amount of alkyl esters of soybean oil and a minor amount of terpene hydrocarbons including a minor amount of insect control agent or fragrance, wherein the fragrance is citronella.

21. An alternative fuel composition comprising a combination of a major amount of alkyl esters of soybean oil and a minor amount of terpene hydrocarbons including a minor amount of an insect control agent or a fragrance, wherein the amount of the insect control agent or the fragrance ranges from about 1.0 to about 10.0 weight percent.

* * * * *